US008128134B2

(12) United States Patent
Kelly

(10) Patent No.: US 8,128,134 B2
(45) Date of Patent: Mar. 6, 2012

(54) DOOR JAMB FINGER GUARD

(76) Inventor: Brian Owen Kelly, Buncrana (IE)

( * ) Notice: Subject to any disclaimer, the term of this patent is extended or adjusted under 35 U.S.C. 154(b) by 1017 days.

(21) Appl. No.: 11/571,233

(22) PCT Filed: Jun. 28, 2005

(86) PCT No.: PCT/IE2005/000073

§ 371 (c)(1),
(2), (4) Date: Dec. 14, 2007

(87) PCT Pub. No.: WO2006/001002

PCT Pub. Date: Jan. 5, 2006

(65) Prior Publication Data

US 2008/0244984 A1 Oct. 9, 2008

(30) Foreign Application Priority Data

Jun. 28, 2004 (IE) ..... S2004/0444

(51) Int. Cl.
*E05C 1/02* (2006.01)
*E05C 1/00* (2006.01)

(52) U.S. Cl. ..... 292/137; 292/144; 292/145; 292/163; 292/175; 292/DIG. 15; 16/82; 49/383

(58) Field of Classification Search ..... 292/137, 292/144, 145, 153, 163, 175, 304, DIG. 15; 16/82; 49/383
See application file for complete search history.

(56) References Cited

U.S. PATENT DOCUMENTS

| | | | | |
|---|---|---|---|---|
| 2,798,751 | A * | 7/1957 | Walden | 292/144 |
| 3,172,168 | A * | 3/1965 | Suska | 49/400 |
| 3,231,880 | A | 1/1966 | Stein | |
| 4,211,443 | A * | 7/1980 | Butts et al. | 292/341.16 |
| 4,579,376 | A * | 4/1986 | Charlton | 292/144 |
| 4,677,834 | A * | 7/1987 | Hicks | 70/279.1 |
| 5,074,073 | A | 12/1991 | Zwebner et al. | |
| 5,076,625 | A * | 12/1991 | Oxley | 292/341.16 |
| 5,419,084 | A | 5/1995 | Sankey et al. | |
| 5,531,086 | A * | 7/1996 | Bryant | 70/279.1 |
| 5,681,070 | A * | 10/1997 | Williams et al. | 292/341.16 |
| 6,027,148 | A * | 2/2000 | Shoemaker | 292/216 |
| 6,079,755 | A * | 6/2000 | Chang | 292/144 |
| 6,145,918 | A * | 11/2000 | Wilbanks, II | 296/146.1 |
| 6,434,888 | B1 | 8/2002 | Shaw et al. | |
| 6,487,751 | B2 * | 12/2002 | Renaud | 16/83 |
| 6,499,325 | B1 * | 12/2002 | Hurskainen | 70/276 |
| 6,874,198 | B2 * | 4/2005 | Renaud | 16/83 |
| 2004/0206006 | A1 * | 10/2004 | De La Coeur et al. | 49/383 |

FOREIGN PATENT DOCUMENTS

| | | |
|---|---|---|
| EP | 1 091 062 A2 | 4/2001 |
| WO | 03/014502 A1 | 2/2003 |

* cited by examiner

*Primary Examiner* — Carlos Lugo
(74) *Attorney, Agent, or Firm* — Edwin S. Flores; Chainey P. Singleton; Chalker Flores, LLP

(57) ABSTRACT

The present invention related to a door jamb finger guard. The finger guard comprises a door lock for preventing closure of the door, a housing for the door lock and a spring activated plate. The spring activated plate is activateable by a door closing obstacle for automatically moving the door lock between an inactive position and an active position. In the inactive position, the door lock is recessed within the housing, while in the active position, the door lock projects from the housing to prevent closure of the door.

22 Claims, 12 Drawing Sheets

DOOR JAMB FINGER GUARD

This invention relates to a door jamb finger guard.

Children, and adults, frequently suffer injury by fingers being trapped between a door and a door stop or a door jamb. In order to prevent such injury, guards have been employed in the past which in general consist of a plastics cover stretched over the gap between the door and the door jamb when the door is open. In general, plastics guards of this type are sprung away from the door hinge in order to force away obstacles as the door is closed.

U.S. Pat. No. 6,434,888 describes a finger guard incorporating a rigid material that cannot be collapsed when pushed upon for preventing fingers from getting into the door gap. U.S. Pat. No. 5,419,084 describes a door jamb finger guard made up of elongate strips hinged together along their edges and being dimensioned so that the strips lie against one another when the door is closed.

According to the invention there is provided a door jamb finger guard comprising:

a door lock for preventing closure of the door;

a housing for the door lock; and activating means activateable by a door closing obstacle for automatically moving the door lock between an inactive position in which the door lock is recessed within the housing and an active position in which the door lock projects from the housing to prevent closure of the door.

In one embodiment, the door jamb finger guard is mountable flush on a door.

Advantageously, the activating means is mounted on the housing.

Preferably, the activating means comprises a spring-activated plate activateable upon contact with the obstacle.

Suitably, the spring-activated plate is communicable with the door lock to effect movement of the door lock between the inactive position and the active position.

Suitably, a lever is disposed between the spring activated plate and the door lock to effect said communication.

Preferably, the door lock is moveable between the inactive position and the active position by at least one biasing means such as a spring.

Suitably, the spring is disposed between the door lock and the housing so as to bias the door lock towards the active position.

In another embodiment, the door jamb finger guard may further comprise a detecting means for detecting a door closing obstacle.

An obstacle may be detected when located in a gap between the door and a door jamb associated with the door.

Preferably, the detecting means is an optical detector which activates the activating means when it detects an interruption to a beam of light located adjacent the gap due to the obstacle being placed in its path.

The door jamb finger guard may further comprise an optical source for emitting the beam of light adjacent to the gap.

Alternatively, the detecting means is a touch sensitive detector.

The touch sensitive detector may comprise a touch sensitive strip mounted adjacent the gap and the saddle of the door.

Desirably, the finger guard is switchable between an on and an off state.

Suitably, the detecting means does not detect obstacles located in the gap when the finger guard is in the off state.

Desirably, when the finger guard is in the on state when the angle of the door relative to its associated door jamb is such that an obstacle placed in the gap would be trapped between the door and the associated door jamb.

The door jamb finger guard may further comprise a second detecting means for detecting the angle of the door relative to its associated door jamb, and switching on the finger guard when the detected angle is within one or more predefined ranges.

The second detecting means may be a mechanically operated door follower, the position of the door follower at any time being representative of the angle of the door relative to its associated door jamb.

The door jamb finger guard may further comprise a first switch and a second switch, the door follower being in contact with one of the switches at any one time, wherein when the door follower is in a position so that it is in contact with the first switch, the finger guard is switched on, and when the door follower is in a position so that it is in contact with the second switch, the finger guard is switched off.

Preferably, the predefined range is between the angles of 21 and 30 degrees.

The activating means may be a pulse communicable with the door lock to effect movement of the door lock between the inactive position and the active position.

The door jamb finger guard may further comprise a lever mechanism co-operating with a solenoid and the door lock, the lever mechanism adapted to move the door lock from the inactive position to the active position upon the solenoid acting on the lever due to the pulse.

Preferably, the lever mechanism is pivotably mounted to the housing, and pivotable between a retracted position, in which position the lever is in contact with the door lock, and an urging position in which position the door lock is urged from the inactive position to the active position upon the solenoid acting on the lever due to the pulse.

Desirably, the door lock is moveable from the inactive position to the active position by at least one biasing means upon movement of the lever to the urging position.

The door jamb finger guard may be mountable substantially to the top corner of a door jamb associated with the door.

Alternatively, the finger guard may be mounted at an angle to a door jamb associated with the door.

Desirably, the finger guard is mounted to the door stop of the door jamb.

The present invention also provides an apparatus for detecting the presence of an obstacle in the gap between a door stop and a door jamb, the apparatus comprising:

the door jamb finger guard; and a reflecting means, wherein light emitted from the optical source is reflected back to the detecting means by the reflecting means.

Desirably, the reflecting means is located substantially at the bottom corner of the door jamb.

Various embodiments of the invention will now be described, by way of example only, having regard to the accompanying drawings in which.

Figure 1:
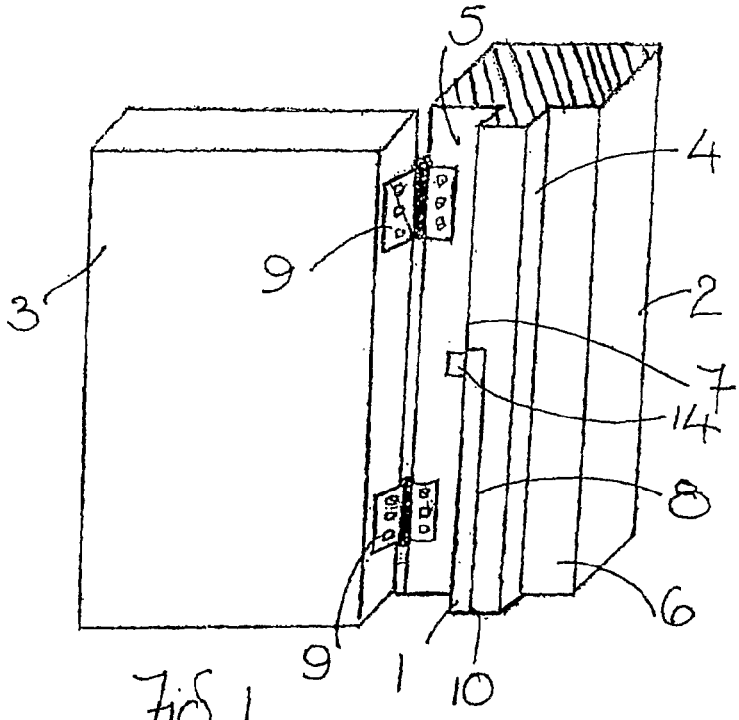
FIG. 1 is a perspective view from above and one-side showing a door, door jamb and associated door stop fitted with a finger guard of the invention with the finger guard in the activated position so that the door cannot be closed.

As shown in the drawings, a finger guard of the invention is generally indicated by the reference numeral (1) and is mountable on a door stop (4) of a door jamb (2) to prevent injury when a door (3) is closed against the door stop (4). As shall be explained more fully below, the finger guard (1) is moveable between a first deactivated position in which the door (3) may be closed against the door stop (4) and a second activated position in which the door (3) is prevented from closing against the door stop (4) when an obstacle such as a child's hand is present.

FIG. 1 shows a perspective view from above and one side of the finger guard (1) mounted on the door stop (4) of the door jamb (2) with the finger guard (1) in the second or activated position so that the door (3) is prevented from closing against the door stop (4). As shown in the drawing, the door (3) and the door jamb (2) are substantially of conventional construction with the door (3) being attached to the door jamb (2) by hinges (9). The door stop (4) is located on the door jamb (2) to define a door jamb inner face (5) on which the hinges (9) are mounted and a door jamb outer face (6) disposed on the opposite side of the door stop (4).

Figure 2:
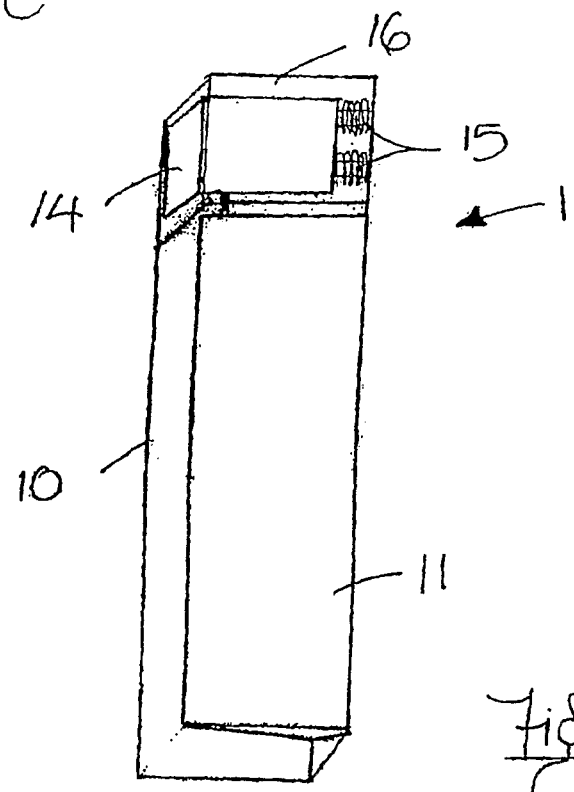
FIG. 2 is an enlarged perspective view from one side of the finger guard of FIG. 1 with the finger guard in the deactivated position.
Figure 3:
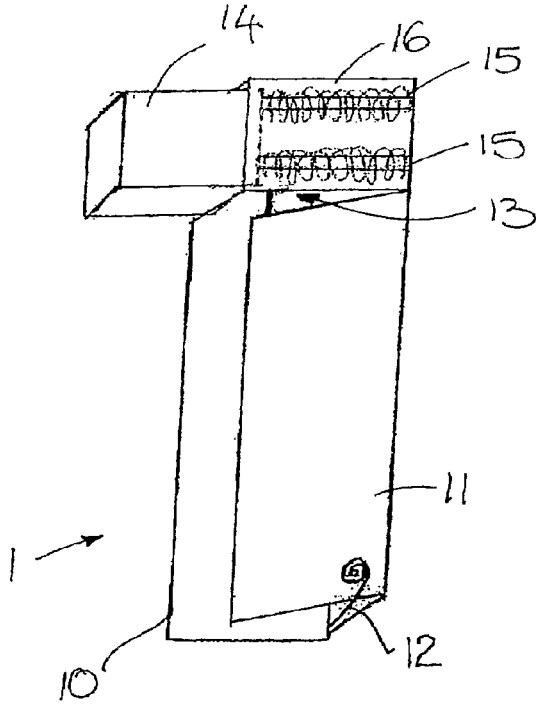
FIG. 3 is a perspective view from one side of the finger guard of FIG. 2 with the finger guard in the activated position.
Figure 4:
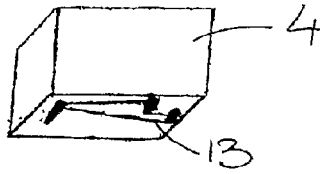
FIG. 4 is an enlarged view of the release lever mounted on the door stop employed to release the locking block of the finger guard.

The door stop (4) is provided with a door stop inner face (7) disposed towards the door jamb inner face (5) and the door (3). A recess (8) is defined in the door stop (4) on the door stop inner face (7) for receiving the finger guard (1). The recess (8) is dimensioned so that the finger guard (l) is flush with the door stop (4) and so that, in the absence of an obstacle, the door (3) will close normally against the door stop (4). As shown in FIG. 2, the finger guard (1) is made up of an outer elongate box-like frame or housing (10). The finger guard (1) is typically dimensioned to be approximately a meter in height when adapted for prevention of injury to young children in particular. The frame (10) is provided with an elongate spring-loaded hinged activating plate (11) adapted to-activate the finger guard (1) and a locking block housing portion (16). In FIG. 2, the spring-loaded hinged activating plate (11) is shown in the first non activated position. The spring-loaded hinged activating plate (11) is moved from the inactive position to the active position by an activating plate spring (12) (See FIG. 3). The spring-loaded hinged activating plate (11) is in communication with a release lever (13) mounted between the spring-loaded hinged activating plate (11) and the door stop (4).

The release lever (13) is in turn in communication with a locking block (14) shown in the inactive position recessed within the locking block housing portion (16) of the frame or housing (1Q) in FIG. 2 via locking block springs (15). Activation of the spring-loaded hinged activating plate (11) results in movement of the release lever (13) to release the locking block springs (15) to in turn rapidly urge the locking block (14) from the locking block housing portion (16) into the second active position. In the active position, the locking block 14) projects from the finger guard (1) to prevent closure of the door (3) against the door stop (4).

Figure 5:
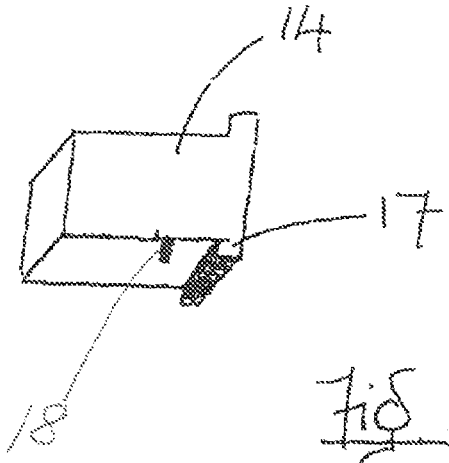
FIG. 5 is an enlarged view of the locking block provided with the small lever.
Figure 6:
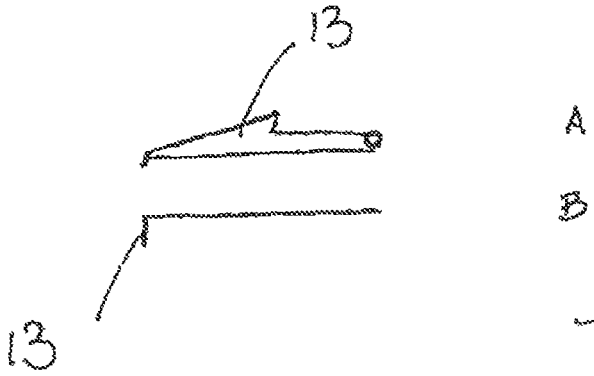
FIGS. 6A and 6B are side and top views respectively of the release lever.
Figure 7:
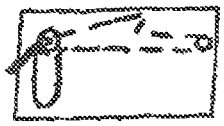
FIG. 7 is a schematic top view of the lever connected to the activating plate.

As shown in FIG. 5, the locking block (14) is dimensioned to be provided with a stop in the form of a rear skirt (17) to prevent the locking block from ejecting fully from the locking block housing portion (16). A small lever (18) projects from the locking block (14) while the locking block (14) is separated from the activating plate (11) by metal typically 1 mm in thickness. The release lever (13) is hinged on the locking block (14) side with the small lever (18) projecting from a slot in the plate which the activating plate (11) depresses to release the locking block (14).

In use, the finger guard (1) can be retrofitted to an existing door stop (4) or incorporated into a door stop (4) during construction of the door stop(4). As indicated above, the finger guard (1) is generally dimensioned to prevent injury to children and the like. However, as will be appreciated by those skilled in the art, the finger guard (1), can be of any size and located in any suitable position to prevent injury to adults.

In the inactive position, the locking block (14) is recessed within the locking block housing portion (16) of the frame or housing (10) with the springs (15) biased against the locking block (14) and the spring-loaded hinged activating plate (11) biased against the activating plate spring (12). Should an obstacle such as a hand be present during closure of the door (3), the activating plate (11) is depressed by the obstacle against the activating plate spring (12) to trigger the release lever (13) which in turn causes the locking block (14) to be rapidly discharged from the locking block housing portion (16) of the frame or housing (10) by the springs (15). The locking block (14) therefore prevents closure of the door on the obstacle to prevent injury.

In order to reset the finger guard (1) of the invention, the locking block (14) is simply urged inwards into the locking block housing portion (16) against the locking block springs (15) and the spring-loaded hinged activating plate (11) returned to the inactive position for further use.

FIGS. 8 to 14 illustrate an alternative embodiment of the present invention. This embodiment provides an optically activated finger guard. The same reference numerals are used in respect of components substantially identical to those previously described in relation to the mechanically operated embodiment.

Figure 13:
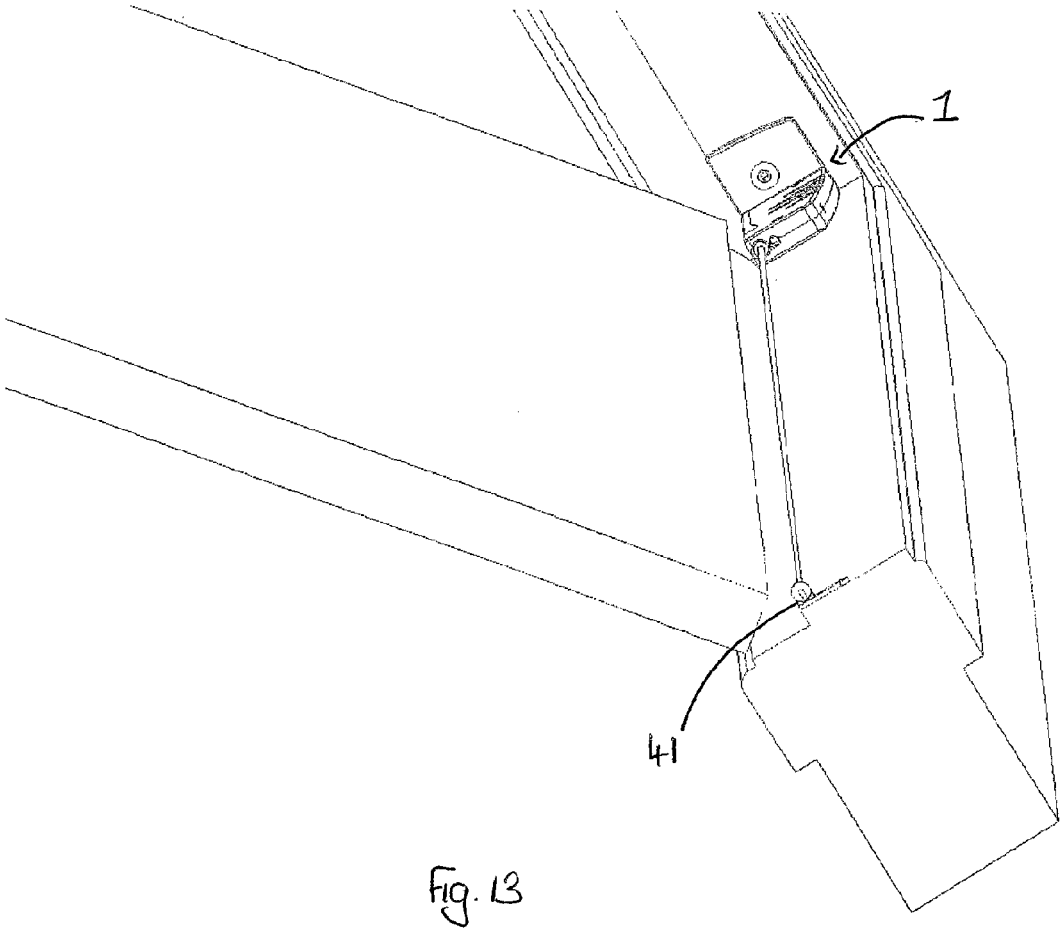
FIG. 13 is a perspective view of the finger guard with optical means operating in conjunction with a reflector and when attached to the door.

This finger guard, rather than being mounted in a recess as per the first embodiment, is mounted substantially to the top corner of the door stop, as shown in FIG. 13. The finger guard is adapted to be easily mounted to any door, regardless of the direction the door is hung.

One aspect of the present invention is for the finger guard to be adapted to be responsive to obstacles (such as fingers) placed in the gap between the door and the door jamb only when the door is in a position where there is a danger of such an obstacle becoming pinched within the gap. This helps to save on power for example where the guard is battery operated. In one construction, the finger guard 1 is accordingly switchable between an on state and an off state, the state at any time being determined by the location of the door relative to the door jamb. Generally it will be set to the on state for those positions of the door where the gap is relatively small so that the gap must be monitored for obstacles, due to the danger of an obstacle becoming trapped in the gap. Usually this arises where the door is moving towards the closed position. Conversely, it is set to the off state when the door is positioned (usually open or close to open) where there is no danger of an obstacle becoming trapped between the door and the jamb in the door gap. In this later state it does not monitor for the presence of obstacles.

In the on state, the locking block 14 may be activated from the inactive to the active position when an obstacle is detected in the door gap, so as to prevent closure of the door. These and other features of the invention will be described in more detail below.

The finger guard of the alternative embodiment comprises two portions, an optical housing 20 and a locking block housing portion 16, as can be seen in FIGS. 8 to 12. The optical housing 20 and locking block housing portion 16 are individually mountable to the door jamb. The orientation of the housing portion 16 relative to the optical housing 20 is reversible. This enables the finger guard to be mounted to a door regardless of the direction the door was hung.

Figure 8:
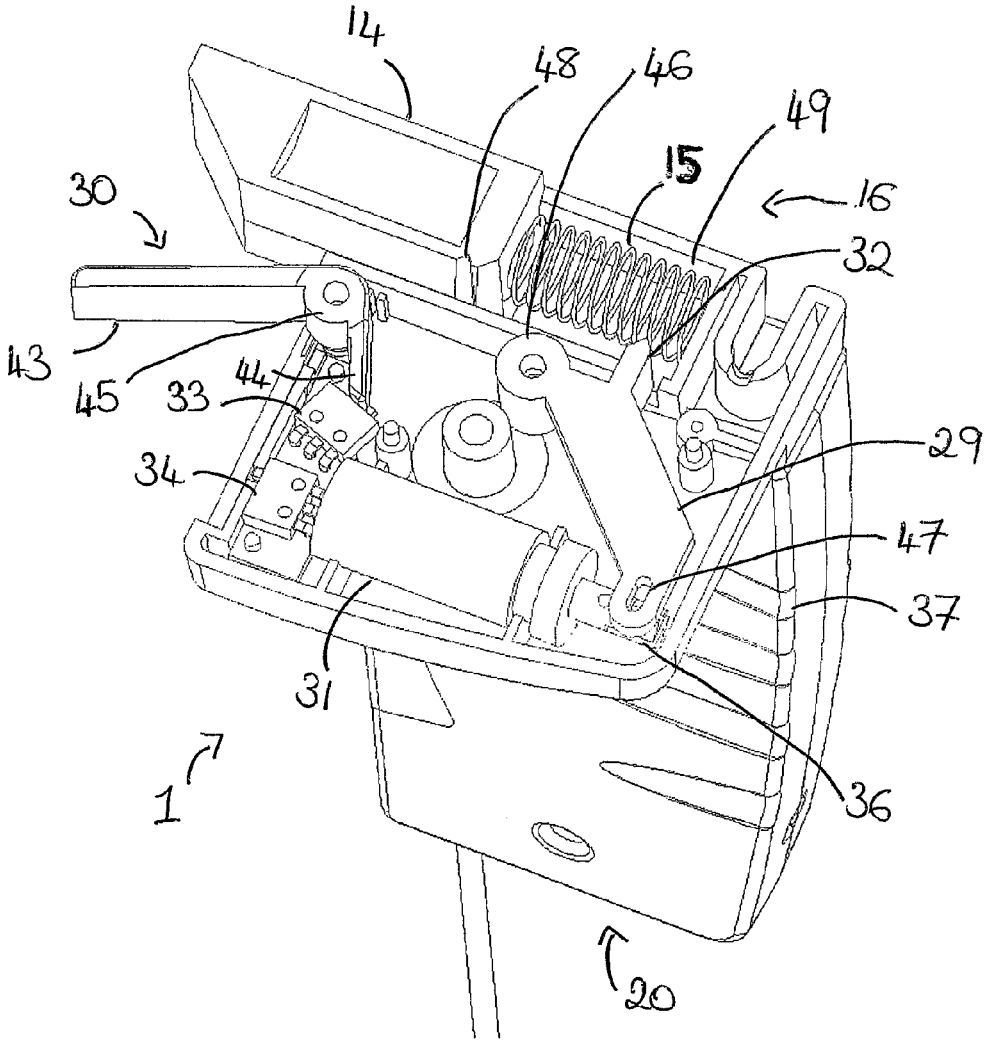
FIG. 8 is a perspective internal view of the lock housing of an alternative embodiment of the finger guard of the present invention which operates by optical detection (when the finger guard is switched on and the locking block is activated)
Figure 9:
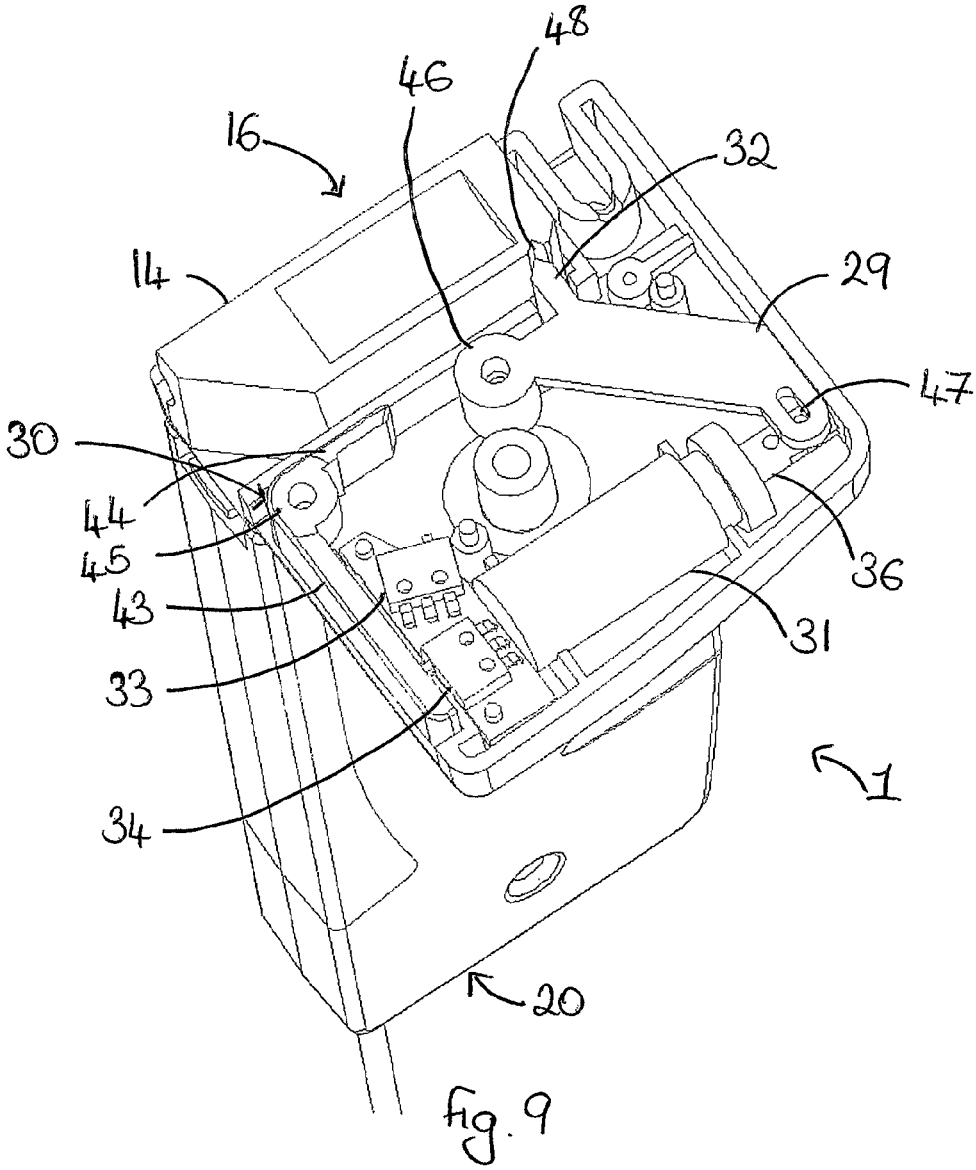
FIG. 9 is a perspective internal view of the lock housing of the embodiment of FIG. 8 with the finger guard switched off.

FIGS. 8 and 9 show the components of the locking block housing 16. The locking block housing 16 holds the locking block 14 and a plurality of components involved in the activation of the locking block 14 and in the switching on and off of the finger guard 1. These components include a spring 15, a lever 29, a plunger 30, a solenoid 31 and two switches, 33 and 34.

The locking block 14 is located in a channel 49. A spring 15 is biased against the locking block, as was the case for the previous embodiment, to facilitate the quick movement of the locking block 14 from the inactive to the active position.

The plunger/lever or door follower 30 indicates/detects the position of the door 3 relative to the door jamb 2, so as to enable the finger guard to be switched on and off as appropriate, depending on the position of the door. To this end, the plunger 30 is adapted to move with the door 3 such that its position is always representative of the angle of the door 3 relative to the door jamb 2. This in turn represents the position of the door fully open, fully closed or at an intermediate position. If desired the off state may be activated in the fully closed position. The plunger 30 is a substantially L-shaped structure, as can be seen from FIG. 8. It comprises an elongate portion 43 and a shorter portion 44 connected at a junction 45. The plunger is pivotably mounted to the housing 16 at its junction 45 so as to provide the freedom of movement necessary to enable the plunger 30 to follow the movement of the door.

In order to provide the necessary switching between the on and off states, the plunger 30 communicates with one of switches 33 and 34 at any time. Switch 33 is adapted to set the finger guard to the on state, while switch 34 is adapted to set the finger guard to the off state. The switches are coupled to control circuitry provided on a printed circuit board (PCB) located in the optical housing 20 to switch on and off of the finger guard as appropriate.

The plunger is adapted to make contact with the appropriate switch for setting the finger guard to the correct state at any time depending on the pivot position of the plunger, which in turn depends on the position of the door.

When the plunger is positioned as shown in FIG. 8, the door should be monitored for obstacles. In this position it can be seen that the shorter portion 44 of the plunger makes contact with switch 33, as shown in FIG. 8, which accordingly sets the finger guard to the on state. Conversely, when the plunger is positioned as shown in FIG. 9, the finger guard does not need to monitor the gap. In this position, the plunger is accordingly adapted so that contact is made between the elongate portion 43 of the plunger and the switch 34, which sets the finger guard to the off state.

The lever 29 moves the locking block 14 between the inactive and active positions when the finger guard is switched on and an obstacle is detected. It is substantially elongate, and is pivotably mounted to the housing 16 at pivot point 46. One end of the lever 29 is provided with a projecting portion or catch member 32. A corresponding wedge shaped slot 48 is provided on the locking block 14 to receive the catch member 32, as shown in FIG. 9. A slot 47 is provided at the other end of the lever 29 for connection to the solenoid 31.

The solenoid is adapted to receive an electric pulse from the PCB and accordingly activate the locking block from the inactive position to the active position upon detection of an obstacle in the door gap. The solenoid 31 is accordingly connected to both the control circuitry provided in the PCB and to the lever 29. The connection between the solenoid 31 and the lever 29 is provided by locating the end pin 36 of the solenoid 31 in slot 47.

When the catch member 32 is in position in the slot 48, as in FIG. 9, the lever is said to be in its parked or retracted position. In this position, the locking block 14 is in its inactive position. If the lever is pulsed by the solenoid, the lever pivots from the parked position to the urging position, which is shown in FIG. 8. In this position, the lever urges the catch member 32 out of the slot 48 of the locking block, and accordingly the locking block is moved from the inactive position to the active position by action of the spring 15. Once the pulse stops, the lever returns to the parked position again.

Figure 10:
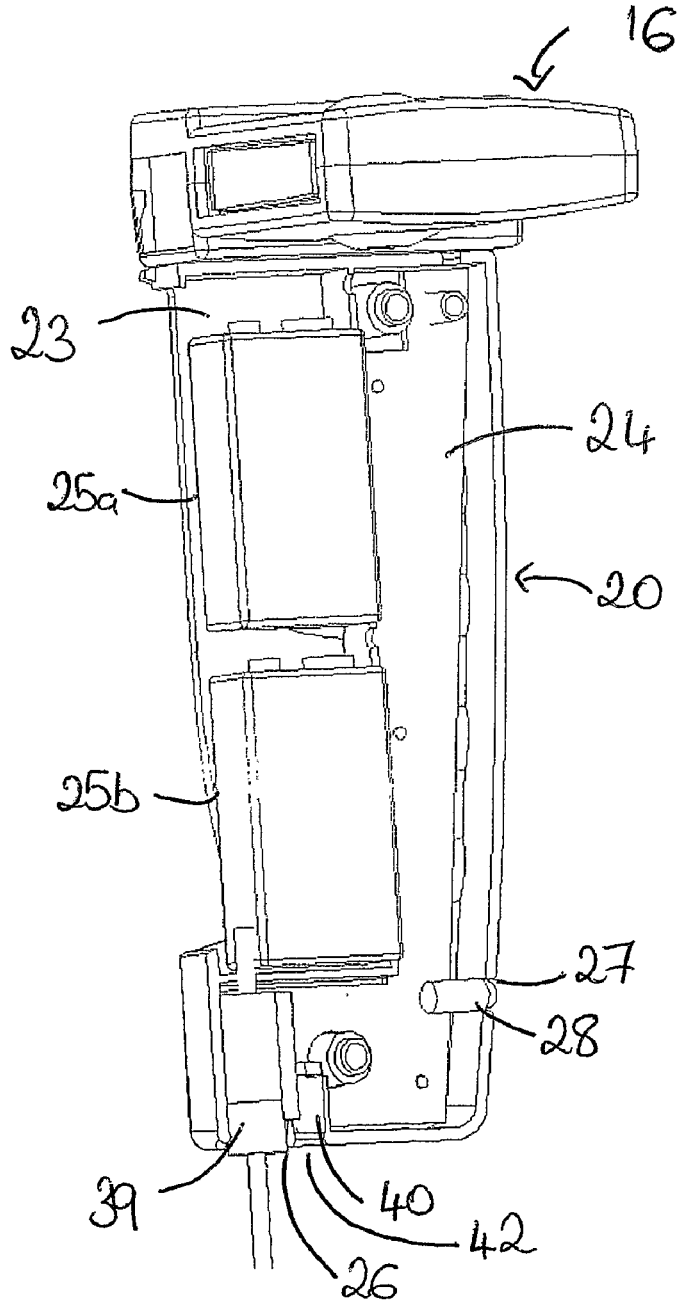
FIG. 10 is a front view of the embodiment of FIG. 8 showing in detail the optical housing.

FIG. 10 shows a detailed internal view of the finger guard, and in particular the components located in the optical housing 20. The components of the optical housing are responsible for detecting the presence of an obstacle in the door gap when the finger guard is switched on. A printed circuit board (PCB) 24 is provided in the optical housing for controlling the switching on and off the finger guard and for pulsing the solenoid when an obstacle has been detected. The PCB 24 is electrically connected to the switches 33 and 34, the laser 39 and the receiver 40.

The optical housing 20 contains an optical source in the form of a laser 39. An aperture 26 is positioned in front of the laser output to pass light generated by the laser 39 external to the housing 20. A detecting means in the form of a receiver 40 located adjacent to the laser 39 is adapted to detect the laser beam reflections. The reflected light is passed to the receiver 40 by means of an aperture 42 located in the housing 20.

When switch 33 sends a signal to the PCB to switch the finger guard on, the PCB turns the laser on and the finger guard is in the on state. The laser 39 then emits light along a length of the door jamb. If an obstacle is placed in the path of the laser beam, the laser beam is interrupted. This interruption is detected by the receiver 40, which sends a control signal to the PCB. The PCB then acts on the solenoid 31 located in the housing 15 to control the locking block to move from the inactive position to the active position.

Conversely, when the switch 34 sends a signal to the PCB to switch the finger guard off, the PCB turns the laser off.

The PCB receives its power from a power source, which, in the described embodiment, is in the form of pair of batteries 25*a* and 25*b*. The batteries 25*a*, 25*b* are coupled to the PCB by means of an electrical socket 23. A battery power indicator LED 28 provides a visual indication of when the finger guard is switched on. The light from the LED 28 passes through the housing by means of aperture 27.

Figure 14:
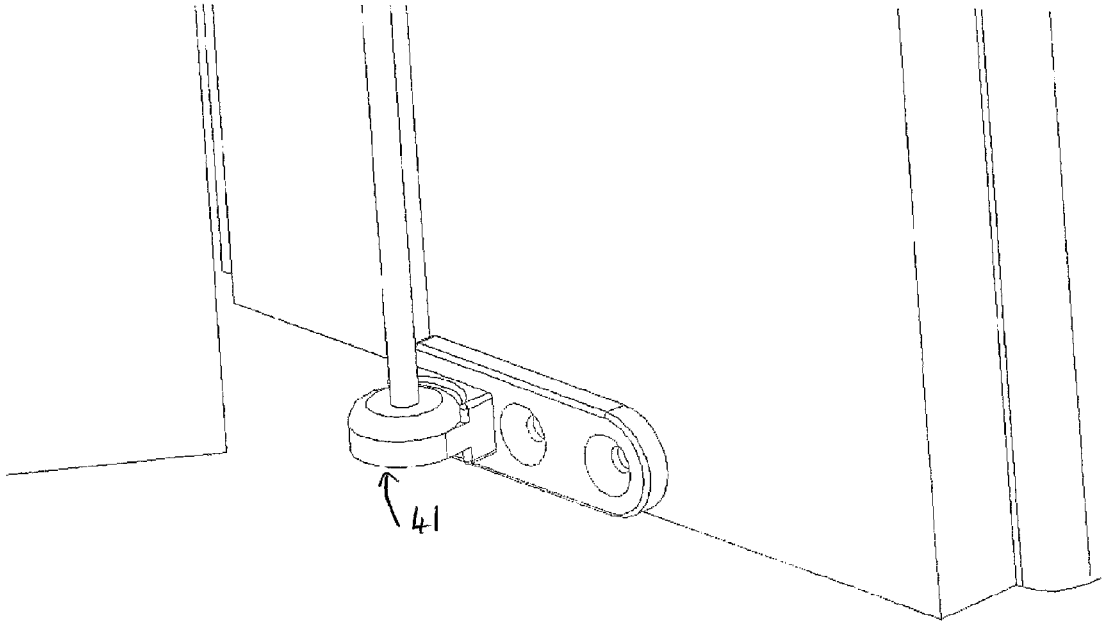
FIG. 14 is a perspective detailed view of the reflector of FIG. 13.

The finger guard 1 operates in conjunction with a reflector 41. FIG. 13 is a perspective view of the finger guard operating in conjunction with the reflector when attached to the door, while FIG. 14 is a perspective detailed view of the reflector.

The reflector 41 is positioned at substantially the bottom corner of the door stop 4, in line with the aperture 26 of the optical housing 20. The reflector is adapted to receive the laser beam emitted from the finger guard 1 when in the on state, and reflect the received beam back in the same direction towards the receiver 40, so as to provide a continuous optical beam along the length of the door stop 4 between the finger guard 1 and the reflector.

Figure 11:
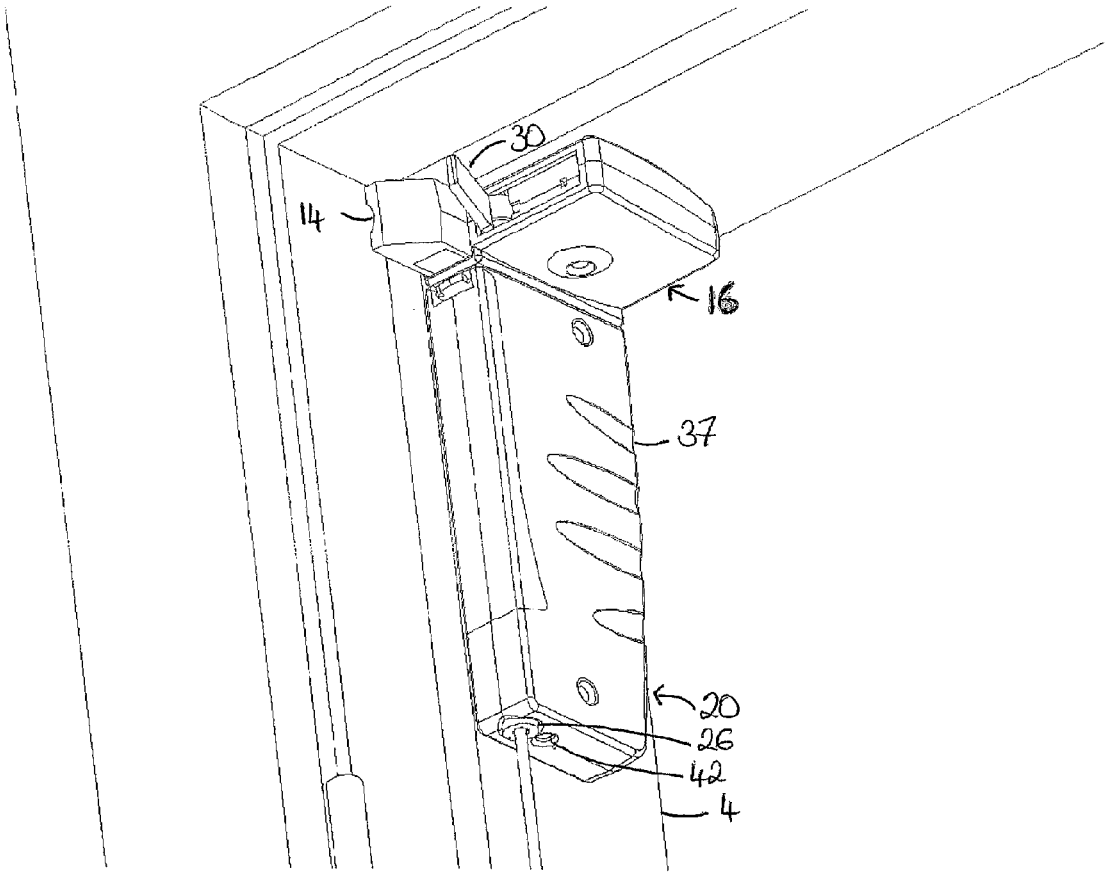
FIG. 11 is a perspective view from the front of the finger guard of the embodiment of FIG. 8 when mounted to the door jamb.
Figure 12:
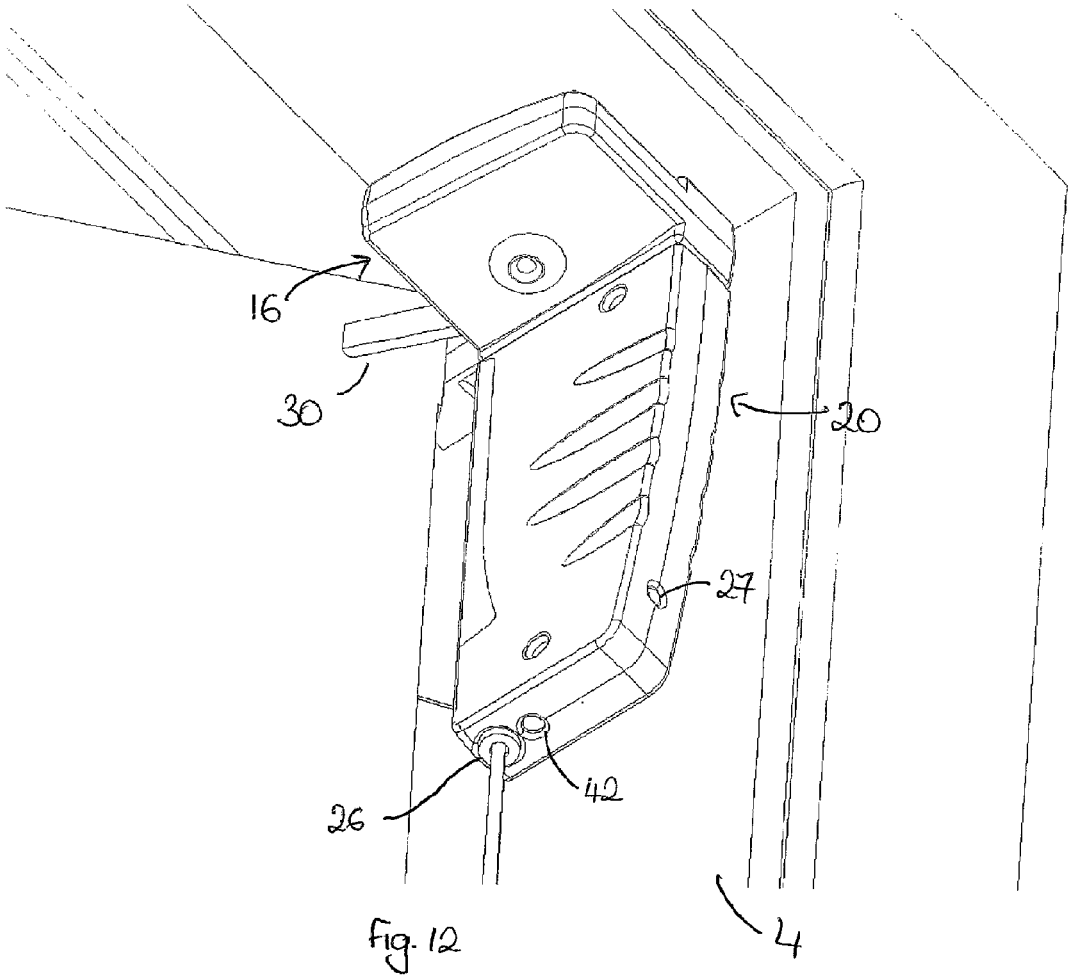
FIG. 12 is a perspective view from the back of the finger guard of the embodiment of FIG. 8 when mounted to the door jamb.

FIG. 11 shows a perspective view from the front of the finger guard of the optical embodiment of the present invention when mounted to the door stop. It can be seen from this figure that a number of grooves 37 are provided on the housing 20. These grooves are ergonomically designed for ease of mounting the finger guard 1 to the door stop 4.

In use, the plunger 30 mechanically detects the position of the door 3 relative to the door jamb 2. While the plunger is in a position such that the shorter portion 44 makes contact with the switch 33, as shown in FIG. 8, the switch 33 sends a signal to the PCB 24 to keep the finger guard in the on state, as in such a position of the plunger the door has the potential to trap fingers. In the described embodiment, the finger guard is adapted to be switched on when the door is positioned between the angles of 30 degrees and 21 degrees relative to the door jamb 2.

When the finger guard is switched on, the PCB controls the laser to emit a continuous beam from the optical housing 20. The beam is received at the reflector, from where it is reflected back to the receiver 40.

Should an obstacle, such as a finger, be placed in the gap between the door and the door jamb, it comes into contact with the laser beam and obstructs its path such that the beam is broken. This break of laser beam is detected at the receiver 40. The receiver 40 then sends a signal to the PCB, which in turn acts on the solenoid 31 to pulse it. This pulse causes the solenoid pin to act on the lever 29 so that it pivots from its parked position to an urging position in such a manner so as to cause the catch member 32 to be release the locking block 14 from the inactive position. The spring 15 then acts on the locking block 14 to move it to the active position, so that the locking block 14 projects from the finger guard 1 to prevent closure of the door 3 against the door stop 4. It should be noted that upon completion of the pulse, the lever pivots back to its parked position.

Conversely, when the plunger is in a position such that the elongate portion makes contact with switch 34, as shown in FIG. 9, the switch 34 sets the finger guard in the off position, as in this position of the plunger there is no danger of trapping fingers. In this off position, the PCB acts on the laser so that it does not emit any laser beam, and consequently will not detect the presence of an obstacle in the gap between the door and the door jamb.

Should the battery become exhausted at any stage, the PCB pulses the solenoid 31 to activate the lever 29 to move the locking block from the inactive position to the active position. This safeguard ensures that there is no possibility of the door closing on an obstacle when the finger guard is not operable.

As was the case with the previous embodiment, the locking block may be moved from the active position back to the inactive position by a resetting mechanism which may be operated by manual means.

Figure 15:
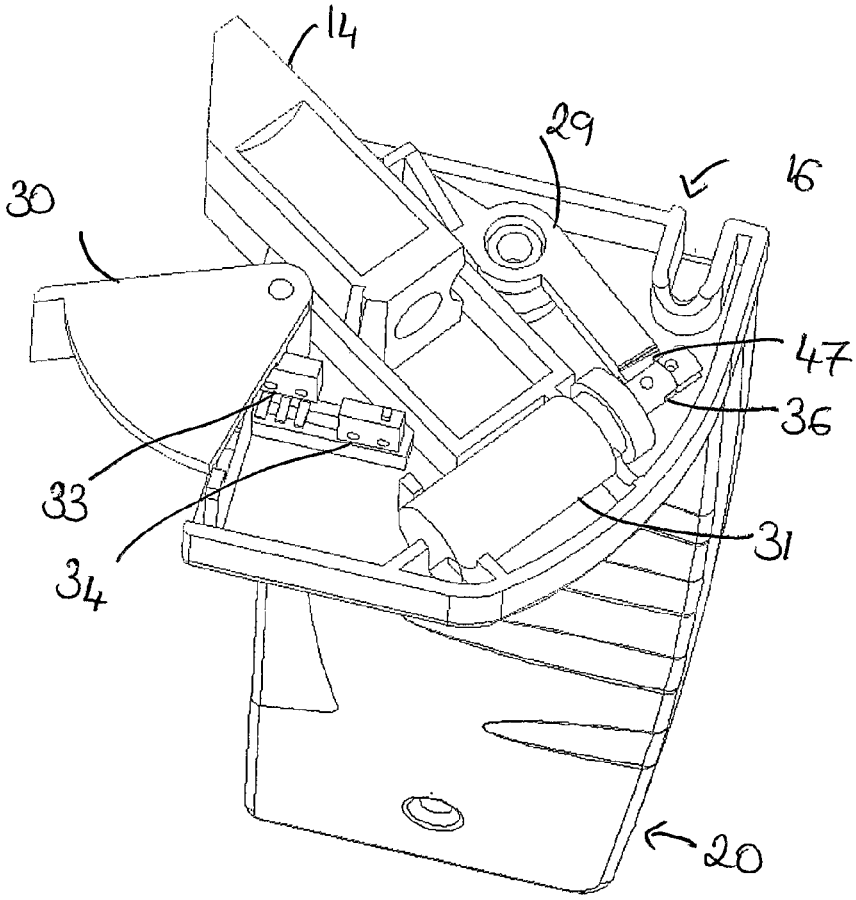
FIG. 15 is a front view of another alternative embodiment of the finger guard of the present invention showing in detail an optical housing and the lock in the active position.
Figure 16:
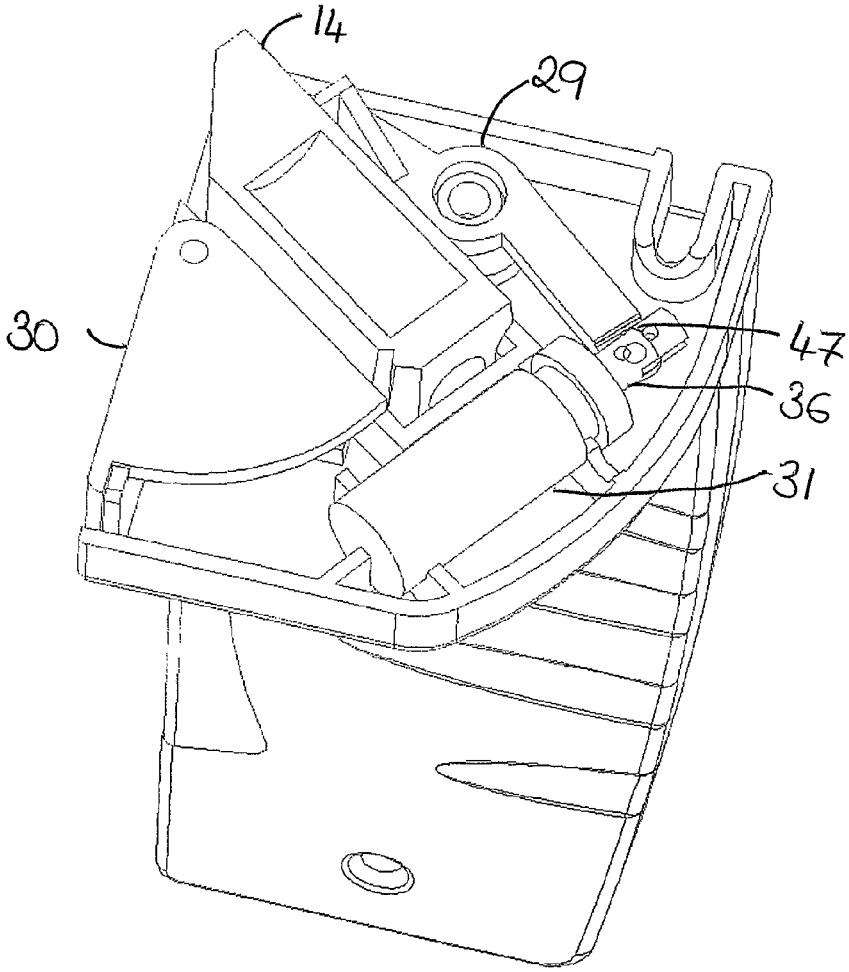
FIG. 16 is a front view of the embodiment of FIG. 15 showing in detail the optical housing.

FIGS. 15 and 16 illustrate a further embodiment of the present invention (this embodiment also incorporates a spring for moving the locking block from the inactive position to the active position, although this is not shown in the drawings). This embodiment provides an alternative optically activated finger guard. The same reference numerals are used for similar components.

The functionality of this second alternative embodiment is identical to that of the first alternative embodiment, with the only difference being in the layout of the components. This embodiment of the finger guard is mounted at an angle to the door stop, rather than flush with the door stop, as was the case with the first alternative embodiment.

Accordingly, the locking block 15 is positioned within the housing 16 such that when in the active position it prevents the door from closing.

It should also be appreciated that the finger guard of the present invention should not be limited solely to those embodiments described. For example, in a further alternative embodiment the detecting means is a touch activated detector. One suitable touch activated detector could be a strip of touch sensitive material such as metal which may be mounted along the (length of the) door stop and for around the saddle of the door. In the first embodiment of the invention, the spring loaded activating plate moves position when depressed by an obstacle. In contrast, the touch sensitive material of this further embodiment does not move upon contact with an obstacle.

The finger guard of the invention is simple to employ and can be easily retrofitted to existing door stops. The finger guard (1) is unobtrusive and lies substantially flush with the door stop (4) when in the inactive position thereby not presenting an obstruction to the normal closure of the door (3) when no obstacle is present.

The words "comprises/comprising" and the words "having/including" when used herein with reference to the present invention are used to specify the presence of stated features, integers, steps for components but does not preclude the presence or addition of one or more other features, integers, steps, components or groups thereof.

It is appreciated that certain features of the invention, which are, for clarity, described in the context of separate embodiments, may also be provided in combination in a single embodiment Conversely, various features of the invention which are, for brevity, described in the context of a single embodiment, may also be provided separately or in any suitable sub combination.

The invention claimed is:

1. A door jamb finger guard comprising:

a door lock for preventing closure of a door, the door lock moving between an inactive and an active position;

a housing for the door lock;

a spring activated plate; and a lever disposed between the door lock and a spring activated plate, the lever maintaining the door lock in the inactive position;

wherein when the spring activated plate is activatable by a door closing obstacle, it moves the lever to automatically allow the door lock to move from the inactive position in which the door lock is recessed within the housing to the active position in which the door lock projects from the housing to prevent closure of the door.

2. The door jamb finger guard as claimed in claim 1 wherein the door jamb finger guard is mountable flush on a door.

3. The door jamb finger guard as claimed in claim 1 wherein the activating means is mounted on the housing.

4. The door jamb finger guard as claimed in claim 1, wherein the door lock is moveable from the inactive position to the active position by at least one spring.

5. The door jamb finger guard as claimed in claim 4, wherein the spring is disposed between the door lock and the housing.

6. A door jamb finger guard comprising a door lock for preventing closure of a door, the door lock moving between an inactive and an active position;

a housing for the door lock;

a detecting means to detect an obstacle located in a gap between the door and a door jamb associated with the door;

a lever disposed between the door lock and the detecting means, the lever maintaining the door lock in the inactive position;

wherein when the detecting means is activatable by a door closing obstacle, it moves the lever to automatically allow the door lock to move from the inactive position in which the door lock is recessed within the housing to the active position in which the door lock projects from the housing to prevent closure of the door;

wherein the finger guard is switchable between an on and an off state and the finger guard is in the on state when the angle of the door relative to the associated door jamb is such that an obstacle placed in the gap would be trapped between the door and the associated door jamb;

a second detecting means for detecting the angle of the door relative to the door jamb and switching on the finger guard when the detected angle is within one or more predefined ranges wherein the second detecting means comprises a mechanically operated door follower and the position of the door follower at any time being representative of the angle of the door relative to the associated door jamb; and a first switch and a second switch, wherein the door follower contacts the first switch or the second switch at any one time, wherein when the door follower is in a position so that it is in contact with the first switch, the finger guard is switched on, and when the door follower is in a position so that it is in contact with a second switch, the finger guard is switched off.

7. The door jamb finger guard as claimed in claim 6 wherein the detecting means is an optical detector which activates the activating means when it detects an interruption to a beam of light located adjacent the gap due to the obstacle being placed in its path.

8. The door jamb finger guard as claimed in claim 7 further comprising an optical source for emitting the beam of light adjacent to the gap.

9. An apparatus for detecting the presence of an obstacle in the gap between a door stop and a door jamb, the apparatus comprising: the door jamb finger guard of claim 8; and a reflecting means, wherein light emitted from the optical source is reflected back to the detecting means by the reflecting means.

10. The apparatus as claimed in claim 9 wherein the reflecting means is located substantially at the bottom corner of the door jamb.

11. The door jamb finger guard as claimed in claim 6 wherein the detecting means is a touch sensitive detector.

12. The door jamb finger guard as claimed in claim 11 wherein the touch sensitive detector comprises a touch sensitive strip mounted adjacent the gap and a saddle of the door.

13. The door jamb finger guard as claimed in claim 6 wherein where the detecting means does not detect obstacles located in the gap when the finger guard is in the off state.

14. The door jamb finger guard as claimed in claim 6, wherein the predefined range is between the angles of 21 and 30 degrees.

15. The door jamb finger guard as claimed in claim 6, wherein the activating means is a pulse communicable with the door lock to effect movement of the door lock between the inactive position and the active position.

16. The door jamb finger guard as claimed in claim 15 further comprising a lever mechanism co-operating with a solenoid and the door lock, the lever mechanism adapted to move the door lock from the inactive position to the active position upon the solenoid acting on the lever due to the pulse.

17. The door jamb finger guard as claimed in claim 16 wherein the lever mechanism is pivotably mounted to the housing, and pivotable between a retracted position, in which position the lever is in contact with the door lock, and an urging position in which position the door lock is urged from the inactive position to the active position upon the solenoid acting on the lever due to the pulse.

18. The door jamb finger guard as claimed in claim 17 wherein the door lock is moveable from the inactive position to the active position by at least one biasing means upon movement of the lever to the urging position.

19. The door jamb finger guard as claimed in claim 6, wherein it is mountable substantially to the top corner of a door jamb associated with the door.

20. The door jamb finger guard as claimed in claim 19 wherein the finger guard is mounted to the door stop of the door jamb.

21. The door jamb finger guard as claimed in claim 6, wherein the finger guard is mounted at an angle to a door jamb associated with the door.

22. A door jamb finger guard comprising:

a door lock for preventing closure of a door, the door lock moving between an inactive and an active position;

a housing for the door lock;

a detecting means to detect an obstacle located in a gap between the door and a door jamb associated with the door; and a lever disposed between the door lock and the detecting means, the lever maintaining the door lock in the active position;

wherein when the detecting means is activatable by the door closing obstacle, it moves the lever to automatically allow the door lock to move from the inactive position in which the door lock is recessed within the housing to the active position in which the door lock projects from the housing to prevent closure of the door.

* * * * *